United States Patent [19]

Freiburger

[11] 4,019,718

[45] Apr. 26, 1977

[54] WINCH CONSTRUCTED SPECIALLY FOR EASY LUBRICATION THEREOF

[75] Inventor: Thomas William Freiburger, Dubuque, Iowa

[73] Assignee: Deere & Company, Moline, Ill.

[22] Filed: May 5, 1975

[21] Appl. No.: 574,555

[52] U.S. Cl. ..... 254/187.5; 254/150 R; 184/6

[51] Int. Cl.[2] ..... B66D 1/00

[58] Field of Search ..... 254/150 R, 186 R, 187 H, 254/187 R, 166; 192/12 R; 310/90; 184/6, 6.12

[56] References Cited

UNITED STATES PATENTS

| | | | |
|---|---|---|---|
| 2,787,065 | 4/1957 | Bock et al. | 254/150 R |
| 3,107,899 | 10/1963 | Henneman | 254/187 H |
| 3,539,046 | 11/1970 | Berg | 254/187 H |
| 3,570,815 | 3/1971 | Nelson | 254/150 R |
| 3,756,564 | 9/1973 | Murray et al. | 254/187 H |
| 3,848,852 | 11/1974 | Therkildsen | 254/150 R |

*Primary Examiner*—Robert J. Spar
*Assistant Examiner*—Kenneth Noland

[57] ABSTRACT

A winch includes hydraulically operated brake and clutch means which comprise part of a drive train supported by and located within a cavity defined by a housing. The drive train includes an output shaft located as the uppermost shaft of the drive train and including a portion extending through a wall of the cavity and axially into one end of a hollow, open-ended cable drum located exteriorly of the cavity and having one end rotatably mounted in a wall of the housing and having its other end rotatably mounted on the output shaft. Coupled to hydraulic fluid circuitry for conveying operating fluid to the brake and clutch means is a lubrication fluid circuit for supplying lubricating fluid to bearings supporting the cable drum and to bearings and other components of the drive train, the lubrication fluid circuit including the interior of the cable drum.

4 Claims, 3 Drawing Figures

WINCH CONSTRUCTED SPECIALLY FOR EASY LUBRICATION THEREOF

BACKGROUND OF THE INVENTION

The present invention relates to a winch structure including lubrication means for components of the winch.

In prior art winches, lubrication fluid is often supplied to various components through means of a plurality of hoses which usually emanate from a common manifold. The connections at the opposite ends of these hoses are potential areas for leakage to occur and provision in the way of shielding or the like must be provided to protect the hoses from damage. Also, the hoses often occupy space that could be used to better advantage for other purposes.

SUMMARY OF THE INVENTION

According to the present invention there is provided a winch construction including means for efficiently and effectively supplying lubrication fluid to various components thereof such as bearings and the like.

A broad object of the invention is to provide a winch constructed such that no conduits such as hoses and pipes, or the like, are necessary to convey lubrication fluid to various locations of the winch.

A more specific object is to provide a winch constructed as set forth in the foregoing paragraph wherein certain primary components of the winch are also used to convey lubrication fluid.

A further object is to provide a winch constructed such that lubrication fluid enters an upper location thereof and exits at a lower location thereof whereby gravity will normally aid the flow of lubrication fluid through the winch.

Yet another object is to provide a winch construction wherein the lubrication fluid is supplied by a circuit connected to the main control circuit for conveying working fluid to and away from fluid operated clutch and brake means of the winch drive train.

These and other objects will become apparent from reading the ensuing description in conjunction with the appended drawings.

DESCRIPTION OF THE PREFERRED EMBODIMENT

Figure 1A:
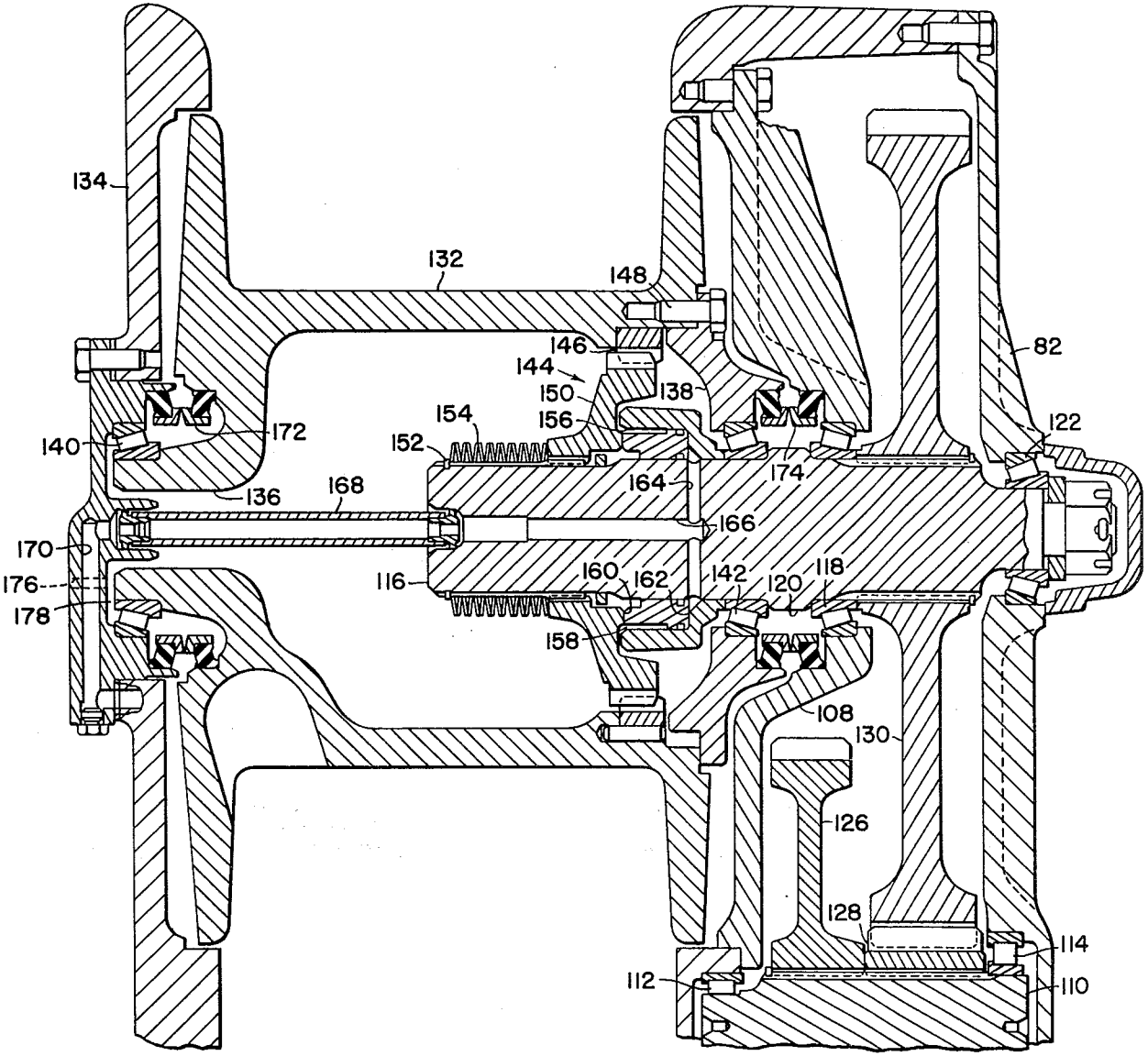
FIG. 1A is a sectional view of the upper portion of a winch embodying features of the present invention with portions of the shafting being shown out of true position for clarity.
Figure 1B:
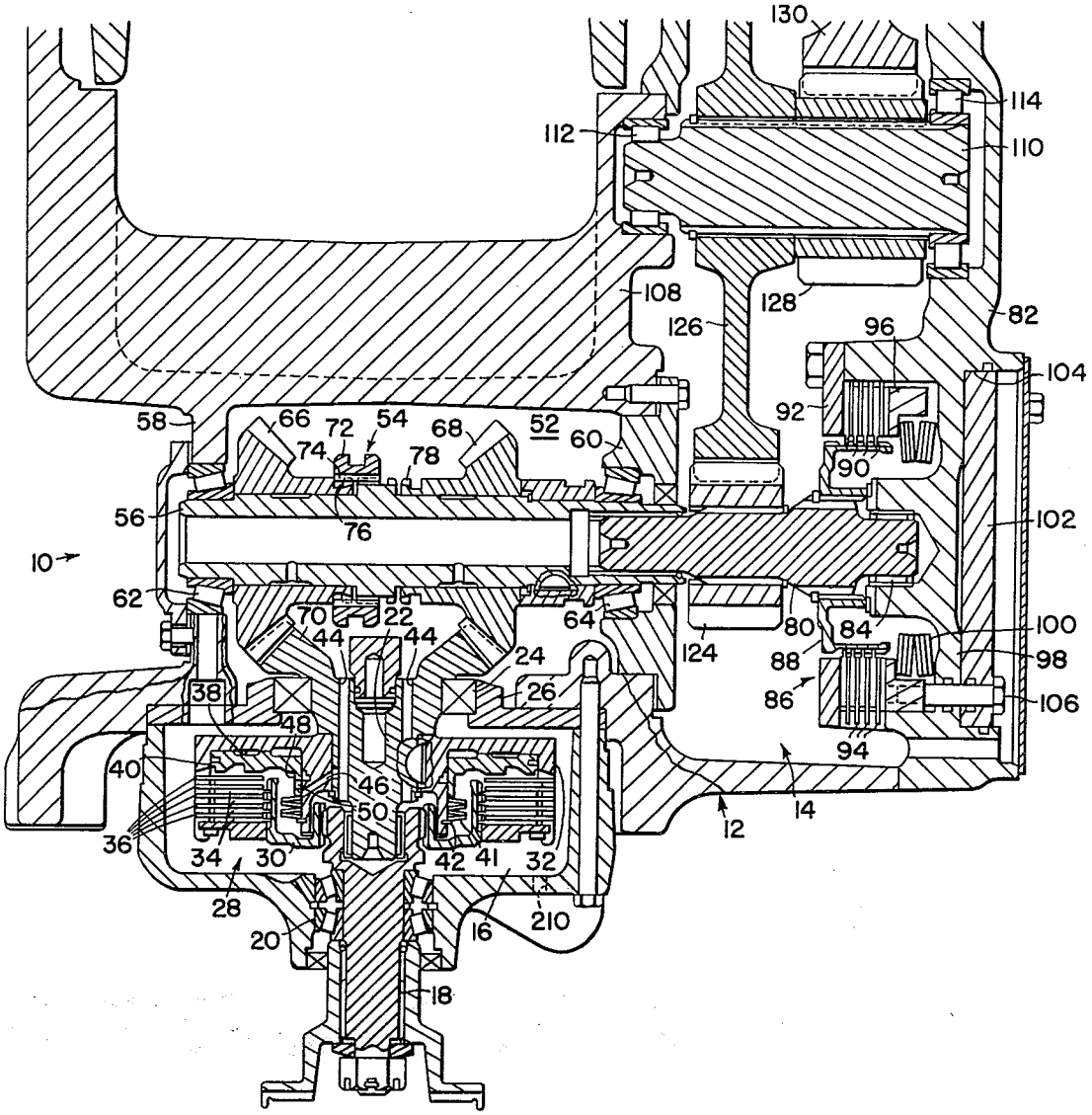
FIG. 1B is a sectional view of the lower portion of the winch shown in FIG. 1A.

Referring now to FIGS. 1A and 1B, there is shown a winch indicated in its entirety by the reference numeral 10. The winch 10 includes a housing 12 defining a fluid-tight cavity or enclosure 14 in which is located various drive train components. The enclosure 14 is defined in part by a main clutch housing 16 here shown at the bottom of the winch in a position displaced angularly approximately 90° from its true position.

An input shaft 18, here shown vertically disposed but actually being horizontally disposed, projects into the housing 16 and is supported in a wall thereof by a bearing set 20. Disposed in axial alignment with the shaft 18 is a short shaft 22 having its lower end rotatably supported in a receptacle formed in the top end of the shaft 18 and further rotatably supported by a shielded bearing 24 located in an end wall 26 of the clutch housing 16.

A main hydraulically operable clutch 28 is located in the housing 16 and includes a first member 30 splined to the upper end of the shaft 18 for rotation therewith and a second member 32 keyed to the shaft 22 for rotation therewith. The member 30 carries a plurality of annular discs 34 which are axially shiftably mounted and the member 32 carries a plurality of annular discs 36 which are interleaved with the drive 34 and are axially shiftably mounted on the member 32. The member 32 defines a cylinder 38 in which is located a piston 40 arranged so as to be selectively shiftable in a direction for compressing the discs 34 and 36 together so as to cause the shaft 22 to be driven by the shaft 18. A stack of Belleville washers 41 normally act between a snap ring 42, carried by the member 30, and the piston 40 to keep the piston 40 shifted away from the discs 34 and 36 and to thus maintain a normally disengaged condition of the main clutch 28.

It is here noted that the main clutch 28 is a "wet clutch", that is to say, it is intended to operate in lubricating fluid. For the purpose of directing such fluid to the discs 34 and 36, passages 44 are provided in the shaft 22 and are connected to passages 46 (only one shown) provided in the member 32. The piston 40 includes a part 48 which normally blocks the passages 46 and is provided with a plurality of ports 50 (only one shown) which move axially into register with the passages 46 when the piston 40 is shifted to compress the discs 34 and 36 against each other to thereby permit lubricating fluid to flow radially outwardly to lubricate and cool the discs 34 and 36.

Another part of the cavity or enclosure 14 is defined by a reverse clutch housing 52 located adjunct to the main clutch housing 16 and having the end wall 26 in common therewith. Located in the housing 52 is a reverse clutch 54 including a tubular shaft 56 having left and right ends respectively rotatable supported in opposite walls 58 and 60 through means of bearings 62 and 64. Mounted for free rotation on the shaft 56 are identical, oppositely disposed left and right bevel gears 66 and 68 which are in constant mesh with diametrically opposite portions of a bevel gear 70 forming one end of the shaft 22. Located between the bevel gears 66 and 68 and axially shiftably splined on the shaft 56 is a shift collar 72. The collar 72 is normally disposed in the position shown wherein internal splines 74 thereof are engaged with external splines 76 on the bevel gear 66. Thus the collar 72 fixes the gear 66 to the shaft 56 to establish a forward or "wind in" drive direction, as will be further described below. Any conventional hydraulically operated arm may be coupled to the collar 72 to shift it rightwardly to disengage it from the gear 66 and engage it with external splines 78 formed on the gear 68 to thereby establish a reverse or "wind out" drive direction.

Forming an extension of the right end of the shaft 56 is a short shaft 80 having its left end received within and splined to the shaft 56 and having its right end supported in an upright wall 82 by a bearing 84.

A hydraulically operable disc brake 86 is constructed to brake the rotation of the shaft 80 and thereby brake the drive train. The brake 86 includes a member 88 splined for rotation with the shaft 80 and having a plurality of annular discs 90 axially shiftably mounted thereon. An annular backup plate 92 is fixed to the wall 82 and is located adjacent the left most disc 90. A plurality of annular discs 94 are interleaved with the discs 90 and are axially shiftably mounted to the wall 82. An annular pressure applying member 96 is located between the right most of the discs 94 and a wall section 98. A stack of Belleville washers 100 are mounted to act between the member 96 and the wall section 98 to normally maintain the brake 86 in an engaged condition, as illustrated, wherein the member 96 and the discs 90 and 94 are compressed together. Disengagement of the brake 86 is accomplished hydraulically by introducing fluid pressure between the wall section 98 and a piston 102 located in a cylinder 104 formed in the wall 82 such that the wall section 98 forms an end thereof, the piston 102 being connected to the pressure applying member 96 through means of a plurality of bolts 106 (only one shown) which project through the piston 102 and the wall section 98 and are threaded into the member 96.

The cavity 14 extends upwardly above the brake 86 and is bounded at its left side by an upright wall portion 108, which forms an upward continuation of the wall 60 of the reverse clutch housing 52, and is bounded at its right side by an upward continuation of the wall 82. A countershaft 110 is located above the shaft 80 and is rotatably mounted in the wall portion 108 and wall 82 respectively through means of bearings 112 and 114 located on the left and right ends thereof. An output shaft 116 is located above the countershaft 110 and is rotatably mounted in the wall portion 108 and wall 82 respectively through means of a bearing 118, mounted on the shaft 116 against the right face of an annular shoulder 120 formed on the shaft 116 approximately midway between the opposite ends thereof, and a bearing 122 mounted on the right end of the shaft 116.

Reduction gearing is provided between the shaft 80 and the output shaft 116 and includes a small pinion 124 splined on the shaft 80 and meshed with a gear 126 splined on the countershaft 110. Adjacent the gear 126, a small pinion 128 is splined on the countershaft 110 and meshed with a gear 130 fixed to the output shaft 116.

The output shaft 116 projects through and extends leftwardly beyond the wall portion 108 and that portion which is to the left of the wall portion 108 projects axially into the right end of a hollow, open-ended cable drum 132. The cable drum 132 is located between the wall portion 108 and an upright wall portion 134 of the housing 12 and has reduced left and right end portions 136 and 138 respectively rotatably mounted in the wall portion 134 and on the shaft 116 respectively through means of a bearing 140 located on the exterior of the portion 136 and a bearing 142 located inside the portion 138.

A hydraulically operable free spool clutch 144 in the form of a gear clutch is provided which normally establishes a drive connection between the output shaft 116 and the cable drum 132. The clutch 144 includes a first gear element in the form of an internal annular spur gear 146 fixed inside the drum 132 adjacent the end portion 136 thereof, the end portion 136 being detachably secured to the remainder of the drum 132 through means of a plurality of cap screws 148 so as to permit installation and removal of the gear 146. The clutch 144 further includes a second gear element in the form of a spur gear 150 splined for rotation with and for axial movement along the shaft 116. The left end of the shaft 116 terminates generally centrally within the drum 132 and located between a snap ring 152, mounted on the shaft 116 adjacent the left end thereof and the left end of the gear 150 is a stack of Belleville washers 154 which are arranged to normally bias the gear 150 to a rightward location, as illustrated, where it is meshed with the gear 146.

Provided for moving the gear 150 axially in the direction of the washers 154 a distance sufficient to disengage the gear 150 from the gear 146 so as to establish a "free spool " condition wherein the winch drum 132 is free of the drive train is a hydraulic actuator including an annular leftwardly opening cylinder 156 fixed on the shaft 116 with its right end against the inner race of the bearing 142 and containing a piston 158 normally having its opposite ends in engagement with a rightwardly facing surface 160 of the gear 150 and an end wall 162 of the cylinder 156. Operating fluid for actuating the piston 158 is routed to the right end thereof through means of radial passages 164 in the shaft 116 which branch from a passage 166 which extends axially in the shaft 116 to the left end thereof whereat it communicates with the right end of an open-ended quill tube 168 having its opposite ends mounted in the shaft 116 and wall portion 135. A passage 170 in the wall portion 134 communicates with the left end of the quill tube 168. Operating fluid is directed to the passage 170 in a manner described below.

An important feature of the invention resides in the fact that the interior of the cable drum 132 serves to convey lubrication fluid for the various bearings, the brake 86 and the main clutch 28 of the winch 10. Forming a part of the structure which makes this function of the drum 132 possible are right and left face seal assemblies 172 and 174 which are respectively located annularly outwardly of the bearing 140 and annularly outwardly of and between the bearings 142 and 118. A lubrication fluid supply passage 176 is provided in the wall portion 134 and communicates with a space 178 between the left end portion 136 of the drum 132 and the wall portion 134 at a level just below the quill tube 168. Thus, it will be appreciated that lubrication fluid will fill the drum 132 to a level sufficiently high to keep the bearings 140, 142 and 118 bathed in fluid. Fluid which passes through the bearing 118 will gravitate to lubricate the bearing 112 at the left end of the countershaft 110 and the bearings 122 and 114 respectively at the right ends of the output and countershafts 116 and 110 are lubricated by oil carried and/or splashed by the reduction gearing carried on the output and countershafts 116 and 110.

Figure 2:
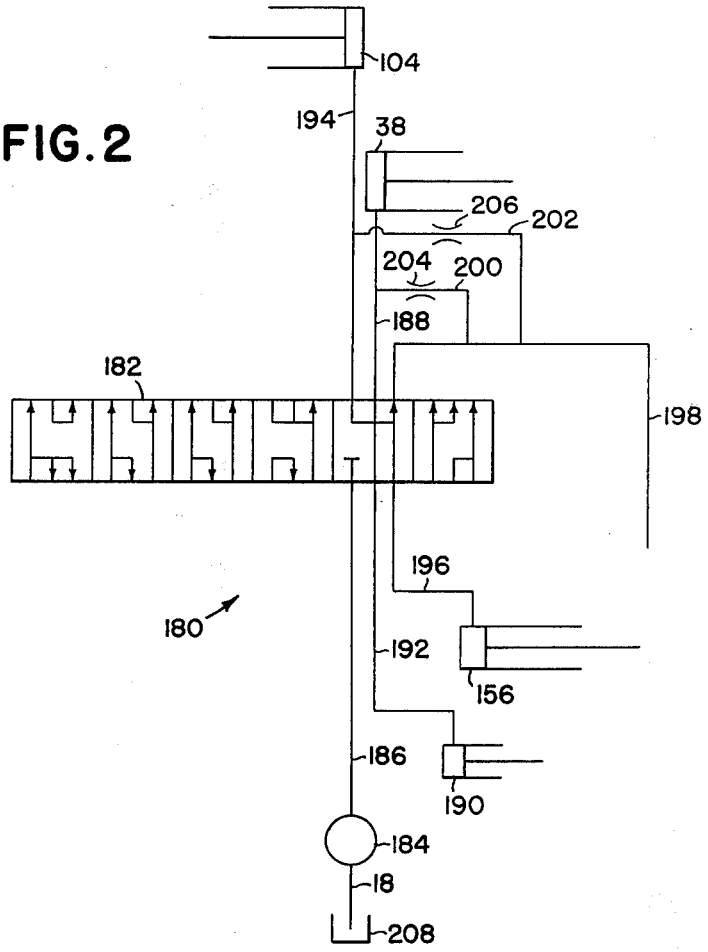
FIG. 2 is a schematic view of the hydraulic system for supplying control and lubrication fluid to the winch.

Referring now to FIG. 2, there is schematically shown a hydraulic system 180 for controlling the operation of and for supplying lubrication fluid to the winch 10. Specifically, the system 180 includes a direction control valve 182 connected to the outlet of a pump 184 by means of a line 186, to the main clutch cylinder 38 by means of a line 188, to a reverse clutch cylinder 190 by means of a line 192, to the brake cylinder 104 by means of a line 194, to the free spool clutch cylinder 156 by a line 196 and to the lubrication fluid passage 176 by means of a line 198. For a purpose to be described hereinafter, the clutch line 188 and brake line 194 are respectively connected to the lubrication fluid line 198 by branch lines 200 and 202 in which flow restrictions 204 and 206 are respectively located. A reservior 208 is connected to the inlet of the pump 184 and to an outlet port 210 located in a lower location of the cavity 14 of the winch 10 at a level approximately equal to that of the input shaft 18 and hence shaft 52.

The operation of the winch 10 is as follows. With the control valve 182 in a neutral position, as illustrated, the pump 184 will be blocked from fluid communication with the various hydraulically operated functions of the winch 10 and the latter will be in a neutral condition, as illustrated, wherein the main clutch 28 is in its normally disengaged condition, the reverse clutch 54 is in its normal condition for establishing a wind in drive condition, the brake 86 is in its normally engaged condition and the free spool clutch 144 is in its normally engaged condition.

To establish a power wind in condition in the winch 10, the operator will shift the control valve 182 leftwardly from its illustrated neutral position. The pump 184 will then be connected to the clutch and brake cylinders 38 and 104, to respectively effect engagement of the main clutch 28 and disengagement of the brake 86 while remaining blocked from the reverse and free spool clutch cylinders 109 and 156. The flow restrictors 204 and 206 serve to ensure that sufficient fluid pressure is supplied to actuate the clutch 28 and brake 86 while at the same time allowing fluid to flow to the lubrication fluid passage 176 by way of the lines 200, 202 and 198. Assuming that lubrication fluid is already present in the cable drum 132 to a level even with the bottom of the bearings 140 and 142 supporting the drum 132, as would normally be the case, the additional fluid supplied through the passage 176 will quickly flow through the bearings 140 and 142 and through the bearing 118 to the cavity 14. Fluid passing through the bearing 118 will find its way to the remaining bearings in the cavity 14 either by being splashed on the bearings or by the gearing in the cavity 14 and/or by gravitating to the bearings.

It is to be noted that since the lubrication fluid outlet port 210 is located at a level substantially equal to that of the input shaft 18, lubrication fluid will normally exist in the cavity 14 to the level of the port 210. Thus, as additional fluid accumulates in the lower portion of the cavity 14 it will return to the sump 208 via the port 210.

It is here noted that rotation of the bevel gears in 66 and 70 the reverser clutch housing 52 causes a pressure which tends to force fluid through the passages 44 and 46, the fluid then passing radially outwardly, due to centrifugal force, to the discs 34 and 36 of the main clutch 28. If the valve 182 is then returned to its illustrated neutral position, it will be appreciated that the pressurized fluid holding the main clutch 28 engaged and the brake 86 disengaged will be exhausted to the lubrication fluid passage 170.

A power wind out condition may be established in the winch 10 by shifting the control valve 182 rightwardly to the third position to the left of the illustrated neutral position. The pump 184 is then connected to effect engagement of the main clutch 28 and disengagement of the brake 86 in the same manner for establishing the power wind in condition in the winch 10 and is also connected to the reverse clutch cylinder 190 for causing the shift collar 72 to be moved rightwardly to release the gear 66 from rotating with the shaft 56 and to fix the gear 68 for rotation with the shaft 56. Lubrication fluid flows to the winch 10 as described above relative to the power wind in condition.

I claim:

1. A winch construction and lubrication means therefor, comprising: a housing defining first and second spaced upright wall sections and a fluid-tight cavity formed in part by said second wall section; a cable drum having a hollow interior and opposite first and second open ends; first and second bearing means rotatably supporting said first and second ends of the cable drum respectively in said first and second wall sections; a drive train located in said cavity and including an output shaft extending into said drum; a lubrication fluid path means including the interior of said cable drum and providing fluid communication among said first and second bearing means and said cavity; said drive train including hydraulically operable main clutch means and brake means including respective pressurizable cylinders; a source of fluid pressure; a reservoir; control valve means connected between said source of fluid pressure and the pressurizable cylinder of said main clutch means, the pressurizable cylinder of said brake means and said lubrication fluid path means; fluid passage means exclusive of said control valve means connecting the pressurizable cylinders of said brake means and said clutch means to said lubrication fluid path means; said control valve means being shiftable at least between a neutral position blocking the source of fluid pressure from the brake means and main clutch means and first operating position wherein the source of fluid pressure is connected to the brake means and clutch means.

2. The winch construction and lubrication means therefor recited in claim 1 wherein said fluid passage means includes first and second branch passages respectively connected to the pressurizable cylinders of said brake means and clutch means and first and second restrictor means located in said first and second branches for controlling the flow of lubrication fluid to said lubrication fluid path means.

3. A winch structure including lubricating means, comprising: a winch housing defining a fluid-tight cavity, a drive train including a plurality of shafts located in said cavity with one shaft being an output shaft located at a level higher than the rest and including a portion extending exteriorly of said cavity; a hollow cable drum located exteriorly of said cavity and having said output shaft extending coaxially therewithin; a plurality of bearing means rotatably supporting said plurality of shafts and said cable drum in said housing; said drive train further including a hydraulically operated brake and a hydraulically operated main clutch located in said cavity and having respective pressurizable cylinders; a source of fluid pressure; a control valve means connected to the source of fluid pressure and to the pressurizable cylinders of the brake and main clutch; a lubrication circuit means connecting said plurality of bearing means in fluid communication with each other and including said hollow cable drum; and said lubrication circuit means further including branched line means connected to the pressurizable cylinders of said brake and said clutch and also to said control valve means.

4. The winch structure recited in claim 3 wherein said branched line means includes flow restrictor means for regulating the amount of flow between the control valve means and the pressurizable cylinders of the brake and clutch and the lubrication circuit means so as to ensure sufficient fluid pressure is supplied to actuate the brake and clutch.

* * * * *